US012716209B2

(12) United States Patent
Noda

(10) Patent No.: US 12,716,209 B2
(45) Date of Patent: Aug. 25, 2026

(54) AUTOMATIC LOADING SYSTEM

(71) Applicant: KOBELCO CONSTRUCTION MACHINERY CO., LTD., Hiroshima (JP)

(72) Inventor: Daisuke Noda, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 591 days.

(21) Appl. No.: 18/245,763

(22) PCT Filed: Aug. 30, 2021

(86) PCT No.: PCT/JP2021/031755
§ 371 (c)(1),
(2) Date: Mar. 17, 2023

(87) PCT Pub. No.: WO2022/064969
PCT Pub. Date: Mar. 31, 2022

(65) Prior Publication Data

US 2023/0323638 A1 Oct. 12, 2023

(30) Foreign Application Priority Data

Sep. 25, 2020 (JP) ..... 2020-161132

(51) Int. Cl.
*E02F 3/43* (2006.01)
*E02F 9/26* (2006.01)

(52) U.S. Cl.
CPC ..... *E02F 9/265* (2013.01); *E02F 3/439* (2013.01); *E02F 9/262* (2013.01)

(58) Field of Classification Search
CPC ..... E02F 3/439; E02F 9/262; E02F 9/265
See application file for complete search history.

(56) References Cited

U.S. PATENT DOCUMENTS

2017/0315561 A1 11/2017 Kadono et al.
2017/0328030 A1* 11/2017 Yamada ..... E02F 9/205
2020/0018049 A1* 1/2020 Takahama ..... E02F 9/2025
(Continued)

FOREIGN PATENT DOCUMENTS

CN 108779624 A 11/2018
WO WO 2016/167375 A1 10/2016
(Continued)

OTHER PUBLICATIONS

International Search Report mailed on Nov. 9, 2021 in PCT/JP2021/031755 filed on Aug. 30, 2021 (2 pages).
(Continued)

*Primary Examiner* — Matthew R Buck
(74) *Attorney, Agent, or Firm* — Oblon, McClelland, Maier & Neustadt, L.L.P.

(57) ABSTRACT

A controller is installed in a work machine and configured to perform loading control based on a detection result of a position detection unit. An external system is arrangeable outside the work machine and communicable with the controller. The external system is configured to output a loading control start signal for starting the loading control. The controller starts the loading control on condition that the loading control start signal has been input from the external system to the controller.

7 Claims, 6 Drawing Sheets

(56) References Cited

U.S. PATENT DOCUMENTS

| | | | | |
|---|---|---|---|---|
| 2020/0224392 | A1 | 7/2020 | Shull | |
| 2021/0010237 | A1 | 1/2021 | Aizawa et al. | |
| 2021/0165414 | A1 | 6/2021 | Aizawa et al. | |
| 2021/0372086 | A1* | 12/2021 | Aizawa | E02F 9/262 |
| 2023/0323638 | A1 | 10/2023 | Noda | |

FOREIGN PATENT DOCUMENTS

| | | | |
|---|---|---|---|
| WO | 2019/168012 | A1 | 9/2019 |
| WO | 2019/168015 | A1 | 9/2019 |
| WO | 2019/181872 | A1 | 9/2019 |
| WO | WO 2020/026504 | A1 | 2/2020 |
| WO | WO 2020/026505 | A1 | 2/2020 |
| WO | WO 2020/026507 | A1 | 2/2020 |
| WO | WO 2020/054418 | A1 | 3/2020 |
| WO | WO 2020/075458 | A1 | 4/2020 |

OTHER PUBLICATIONS

Extended European Search Report issued Jan. 18, 2024 in European Patent Application No. 21872101.7, 7 pages.
Combined Chinese Office Action and Search Report issued on Sep. 23, 2025 in Chinese Patent Application No. 202180063651.3 (with English translation of Office Action), 12 pages.
U.S. Office Action issued in U.S. Appl. No. 19/056,558 on Aug. 28, 2025.

* cited by examiner

AUTOMATIC LOADING SYSTEM

TECHNICAL FIELD

The present invention relates to an automatic loading system for allowing a work machine to automatically load a conveyance object on a carrier.

BACKGROUND ART

For example, Patent Literature 1 and the like disclose a conventional automatic loading system. In the technique disclosed in Patent Literature 1, when detecting approach of a carrier to a work machine, a controller that controls the work machine sets a loading mode of operating the work machine to perform loading on the carrier (see claim 1 in Patent Literature 1).

In the technique disclosed in Patent Literature 1, even when the work machine is not in a state suitable for performing loading on the carrier, control for loading (loading control) is performed if approach of the carrier is detected improperly, for example.

CITATION LIST

Patent Literature

Patent Literature 1: WO 2020/026505 A

SUMMARY OF INVENTION

Therefore, an object of the present invention is to provide an automatic loading system capable of creating a room for a determination subject other than a controller to determine, before the loading control is started, whether loading control can be started.

The automatic loading system includes a work machine, a position detection unit, a controller, and an external system. The work machine performs a capturing operation of capturing a conveyance object and a releasing operation of loading the captured conveyance object on a carrier. The position detection unit detects the position of the carrier with respect to the work machine. A controller is installed in the work machine and is configured to perform loading control based on a detection result of the position detection unit. The external system is arrangeable outside the work machine and communicable with the controller. The loading control is control that causes the work machine to repeatedly perform a series of operations including the capturing operation and the releasing operation. The external system is configured to output a loading control start signal for starting the loading control. The controller starts the loading control on condition that the loading control start signal has been input from the external system to the controller.

DESCRIPTION OF EMBODIMENTS

Figure 1:
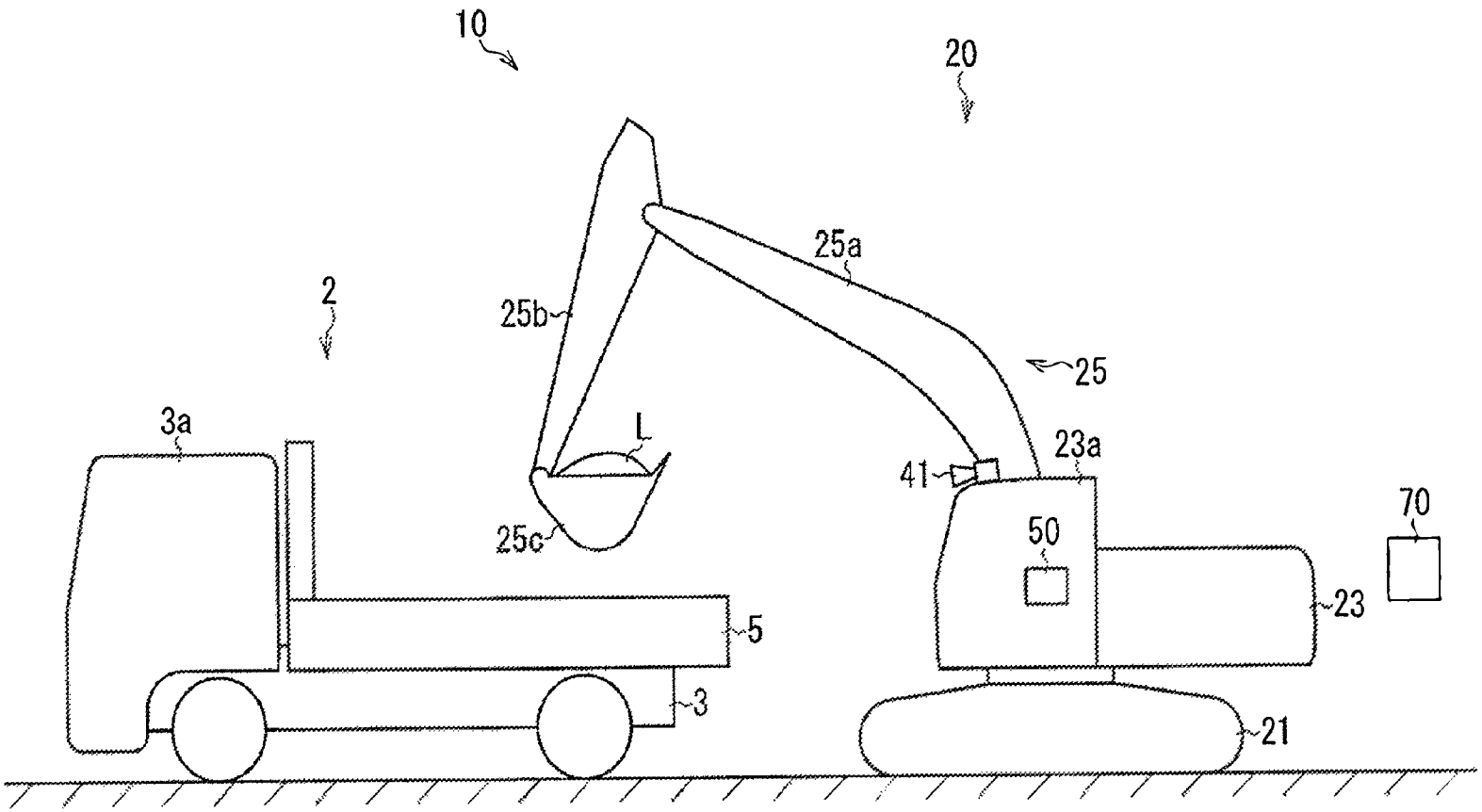
FIG. 1 is a diagram of an automatic loading system 10 and the like, and is a diagram of a carrier 2 and a work machine 20 as viewed from a side.

An automatic loading system 10 for loading a conveyance object L on a carrier 2 shown in FIG. 1 will be described with reference to FIGS. 1 to 3.

The carrier 2 is a vehicle including a platform 5. The carrier 2 is a vehicle that transports the conveyance object L loaded by the work machine 20. The carrier 2 may be a dump car or a truck. The carrier 2 includes a carrier body 3 and the platform 5. The carrier body 3 can travel and supports the platform 5. The carrier body 3 includes a carrier cab 3*a*. The platform 5 accommodates the conveyance object L. The conveyance object L stored in the platform 5 may be, for example, earth and sand, a stone, a waste, or the like. The platform 5 may be movable with respect to the carrier body 3 or may be fixed to the carrier body 3.

The automatic loading system 10 is a system that causes the work machine 20 to automatically perform work of loading the conveyance object L on the carrier 2. The automatic loading system 10 includes the work machine 20 and a position detection unit 41, and an instruction unit 42, a controller 50, and an external system 70 shown in FIG. 2.

As shown in FIG. 1, the work machine 20 is a machine that performs work, is, for example, a construction machine that performs construction work, and is, for example, an excavator. The work machine 20 performs a capturing operation of capturing the conveyance object L and a releasing operation of loading the captured conveyance object L on the carrier 2 (details of the capturing operation and the releasing operation will be described later). The work machine 20 includes a lower travelling body 21, an upper slewing body 23, and an attachment 25, and also a drive control unit 31 and an orientation detection unit 33 shown in FIG. 2.

The lower travelling body 21 causes the work machine 20 shown in FIG. 1 to travel. The lower travelling body 21 includes, for example, a crawler. The upper slewing body 23 is installed in the lower travelling body 21 so as to slew. The upper slewing body 23 includes a work machine cab 23*a*.

The attachment 25 is mounted on the upper slewing body 23 so as to be raised and lowered. The attachment 25 is a device that captures, moves, and releases the conveyance object L. The attachment 25 includes a boom 25*a*, an arm 25*b*, and a distal end attachment 25*c*. The boom 25*a* is mounted on the upper slewing body 23 so as to be raised and lowered (rotatable up and down). The arm 25*b* is rotatably (so as to be pushed and pulled) attached to the boom 25*a*. The distal end attachment 25*c* is provided at a distal end of the attachment 25 and is rotatably attached to the arm 25*b*. The distal end attachment 25*c* may be a bucket that scoops the conveyance object L (for example, earth and sand) or a device (for example, a grapple) that pinches and holds the conveyance object L.

The drive control unit 31 (see FIG. 2) controls an actuator (not shown) that drives the work machine 20. Specifically, the drive control unit 31 controls a motor that causes the lower travelling body 21 to travel and a motor that causes the upper slewing body 23 to slew with respect to the lower travelling body 21. The drive control unit 31 controls a cylinder that raises and lowers the boom 25*a* with respect to the upper slewing body 23, a cylinder that rotates the arm 25*b* with respect to the boom 25*a*, and a cylinder that rotates the distal end attachment 25*c* with respect to the arm 25*b*. In a case where the distal end attachment 25*c* itself operates (for example, opens and closes), the drive control unit 31 controls an actuator that operates the distal end attachment 25*c*.

The orientation detection unit 33 (see FIG. 2) detects an orientation of the work machine 20 in order to perform standby control C1 (step S12 in FIG. 3) and loading control C2 (step S32 in FIG. 3) described later. Specifically, the orientation detection unit 33 detects a slewing angle of the upper slewing body 23 with respect to the lower travelling body 21. The orientation detection unit 33 detects a rotation angle (derricking angle) of the boom 25*a* with respect to the upper slewing body 23, a rotation angle of the arm 25*b* with respect to the boom 25*a*, and a rotation angle of the distal end attachment 25*c* with respect to the arm 25*b*. The orientation detection unit 33 may include, for example, an angle sensor that detects the slewing angle and a plurality of angle sensors that detects the rotation angles.

The position detection unit 41 detects the position of the carrier 2 with respect to the work machine 20. Specifically, the position detection unit 41 detects three-dimensional position information of the carrier 2 and detects three-dimensional shape information of the carrier 2. The position detection unit 41 may detect the position of the carrier 2 based on three-dimensional information and two-dimensional information (image). The position detection unit 41 may detect the position of only a part of the carrier 2, for example, may detect the position of only the platform 5 of the carrier 2.

Only one position detection unit 41 may be provided, or a plurality of position detection units may be provided. The position detection unit 41 may be installed in the work machine 20 or may be arranged outside the work machine 20 (for example, at a work site). In a case where the position detection unit 41 is arranged outside the work machine 20, it may be possible to detect a position that cannot be detected (for example, a portion hidden by the attachment 25) if the position detection unit 41 is installed only in the work machine 20. In a case where the position detection unit 41 is arranged outside the work machine 20, the automatic loading system 10 according to the present embodiment can be applied although the position detection unit 41 is not installed in the work machine 20.

The position detection unit 41 may include a device that detects three-dimensional information by using laser light, and may include, for example, a light detection and ranging or laser imaging detection and ranging (LiDAR) or a time of flight (TOF) sensor. The position detection unit 41 may include a device (for example, a millimeter wave radar) that detects three-dimensional information by using radio waves. The position detection unit 41 may include a stereo camera. In a case where the position detection unit 41 detects the position of the carrier 2 based on the three-dimensional information and the two-dimensional information, the position detection unit 41 may include a camera capable of detecting a two-dimensional image.

The instruction unit 42 (see FIG. 2) performs an instruction described later. The instruction unit 42 may perform an instruction perceptible by an operator (person) or may output an instruction by an electric signal (for example, an instruction for control). When the instruction unit 42 performs an instruction perceptible by the operator, the instruction unit 42 outputs an instruction by at least one of sound, light, or vibration to the operator. The instruction unit 42 may be installed in the work machine 20 or may be arranged outside the work machine 20. The instruction unit 42 may be provided in the external system 70. The instruction unit 42 may be a horn (for example, a horn installed in the work machine 20), a speaker, a light, or a display device (such as a monitor).

The controller 50 is a computer that inputs and outputs signals, performs arithmetic such as determination and calculation, stores information, and the like. The controller 50 is installed in the work machine 20. The controller 50 can perform the standby control C1 (step S12 in FIG. 3) and the loading control C2 (step S32 in FIG. 3) described later. The controller 50 controls the operation of the work machine 20 by outputting a command to the drive control unit 31 (see FIG. 2).

The external system 70 is a computer provided separately from the controller 50. The external system 70 is communicable with the controller 50. The external system 70 is arrangeable outside the work machine 20. The external system 70 may be, for example, a system installed outside the work machine 20 (such as a server) or a portable device (portable terminal, tablet terminal, or the like). Note that the external system 70 can be arranged outside the work machine 20, and may be arranged inside the work machine 20 (for example, inside the work machine cab 23*a*). Communication between the external system 70 and the controller 50 may be wireless communication or wired communication. As shown in FIG. 2, the external system 70 includes a display unit 71, a standby control start instruction unit 73, a loading control start instruction unit 75, and an interruption instruction unit 77. The external system 70 may include an automatic determination unit 79.

The display unit 71 displays various information. The display unit 71 displays to cause the operator to determine whether the controller 50 can start automatic control (specifically, the standby control C1 and the loading control C2 shown in FIG. 3) (see FIGS. 4 to 6).

The standby control start instruction unit 73 causes the external system 70 to output a standby control start signal 73*s*. The standby control start signal 73*s* is a signal for causing the controller 50 to start the standby control C1 (see FIG. 3). The standby control start instruction unit 73 causes the external system 70 to output the standby control start signal 73*s* in accordance with an operation by the operator. The operation performed by the operator on the standby control start instruction unit 73 may be, for example, an operation of a touch panel, an operation of a physical switch, or a voice operation.

The loading control start instruction unit 75 causes the external system 70 to output a loading control start signal 75*s*. The loading control start signal 75*s* is a signal for causing the controller 50 to start the loading control C2 (see FIG. 3). The loading control start instruction unit 75 causes the external system 70 to output the loading control start signal 75*s* in accordance with an operation by the operator. The operation performed by the operator on the loading control start instruction unit 75 may be, for example, an operation of a touch panel, an operation of a physical switch, or a voice operation.

The interruption instruction unit 77 causes the external system 70 to output an interruption signal 77*s* for causing the controller 50 to interrupt the automatic control. The interruption instruction unit 77 causes the external system 70 to output the interruption signal 77*s* in accordance with an operation by the operator. The operation performed by the operator on the interruption instruction unit 77 may be, for example, an operation of a touch panel, an operation of a physical switch, or a voice operation. The interruption instruction unit 77 may cause the external system 70 to output the interruption signal 77*s* (standby control interruption signal) for causing the controller 50 to interrupt the standby control C1 (see FIG. 3). The interruption instruction unit 77 may cause the external system 70 to output the interruption signal 77*s* (loading control interruption signal) for causing the controller 50 to interrupt the loading control C2 (see FIG. 3). Note that the automatic determination unit 79 will be described later.

(Operation of Work Machine 20)

The work machine 20 shown in FIG. 1 performs a capturing operation, a lifting movement operation, a releasing operation, and a returning movement operation.

The capturing operation is an operation of the distal end attachment 25*c* capturing the conveyance object L. For example, the capturing operation may be an operation (excavating operation) of a bucket which is the distal end attachment 25*c* excavating and scooping earth and sand which is the conveyance object L. For example, the capturing operation may be an operation of the distal end attachment 25*c* pinching and holding the conveyance object L.

The lifting movement operation is an operation of the distal end attachment 25*c* moving (moving the conveyance object L) from the position where the capturing operation has been performed to the position where the releasing operation is to be performed. The lifting movement operation is an operation of the distal end attachment 25*c* moving along a target trajectory (see a target trajectory Qa shown in FIG. 6). Specifically, for example, the lifting movement operation is an operation (lifting slewing operation) including an operation of the upper slewing body 23 slewing with respect to the lower travelling body 21 and an operation of the distal end attachment 25*c* moving (for example, moving upward or the like) with respect to the upper slewing body 23.

The releasing operation is an operation of the distal end attachment 25*c* releasing the conveyance object L at a position above the carrier 2 (specifically, the platform 5) and loading the conveyance object L on the carrier 2. For example, the releasing operation may be an operation (soil discharging operation) of the bucket which is the distal end attachment 25*c* dropping earth and sand which is the conveyance object L to the platform 5. For example, the releasing operation may be an operation of the distal end attachment 25*c* releasing and dropping, to the platform 5, the conveyance object L having been pinched and held by the distal end attachment 25*c*.

The returning movement operation is an operation of the distal end attachment 25*c* moving (returning) from the position where the releasing operation has been performed to the position where the capturing operation is to be performed. The returning movement operation is an operation of the distal end attachment 25*c* moving along a target trajectory (see a target trajectory Qa shown in FIG. 6). Specifically, for example, the returning movement operation is an operation (returning slewing operation) including an operation of the upper slewing body 23 slewing with respect to the lower travelling body 21 and an operation of the distal end attachment 25*c* moving (for example, moving downward or the like) with respect to the upper slewing body 23.

(Automatic Control by Controller 50)

The controller 50 performs control (automatic control) for automatically operating the work machine 20. The automatic control performed by the controller 50 includes the standby control C1 (see step S12 shown in FIG. 3) and the loading control C2 (see step S32 shown in FIG. 3). Hereinafter, the work machine 20 will be described mainly with reference to FIG. 1, and each step of the flowchart, the standby control C1, and the loading control C2 will be described with reference to FIG. 3.

The standby control C1 (see step S12 shown in FIG. 3) is control that causes the work machine 20 shown in FIG. 1 to perform the capturing operation and then causes the work machine 20 to stand by in a standby orientation. Specifically, the standby control C1 is control that causes the work machine 20 to perform the capturing operation (for example, excavation), perform the lifting movement operation (for example, slewing), and stand by in the standby orientation. The "standby orientation" is an orientation for loading the captured conveyance object L on the carrier 2, and is an orientation for standing by for the releasing operation (preliminary preparation orientation). The standby orientation is such an orientation that the work machine 20 can immediately perform the releasing operation when the controller 50 outputs a command to perform the releasing operation. Specifically, for example, the standby orientation is an orientation in which the distal end attachment 25*c* (for example, a bucket containing earth and sand) capturing the conveyance object L stops at a position (in the air) where the releasing operation is scheduled to be performed (for example, a soil discharging standby orientation). The orientation of the work machine 20 shown in FIG. 1 is an example of the standby orientation.

Figure 6:
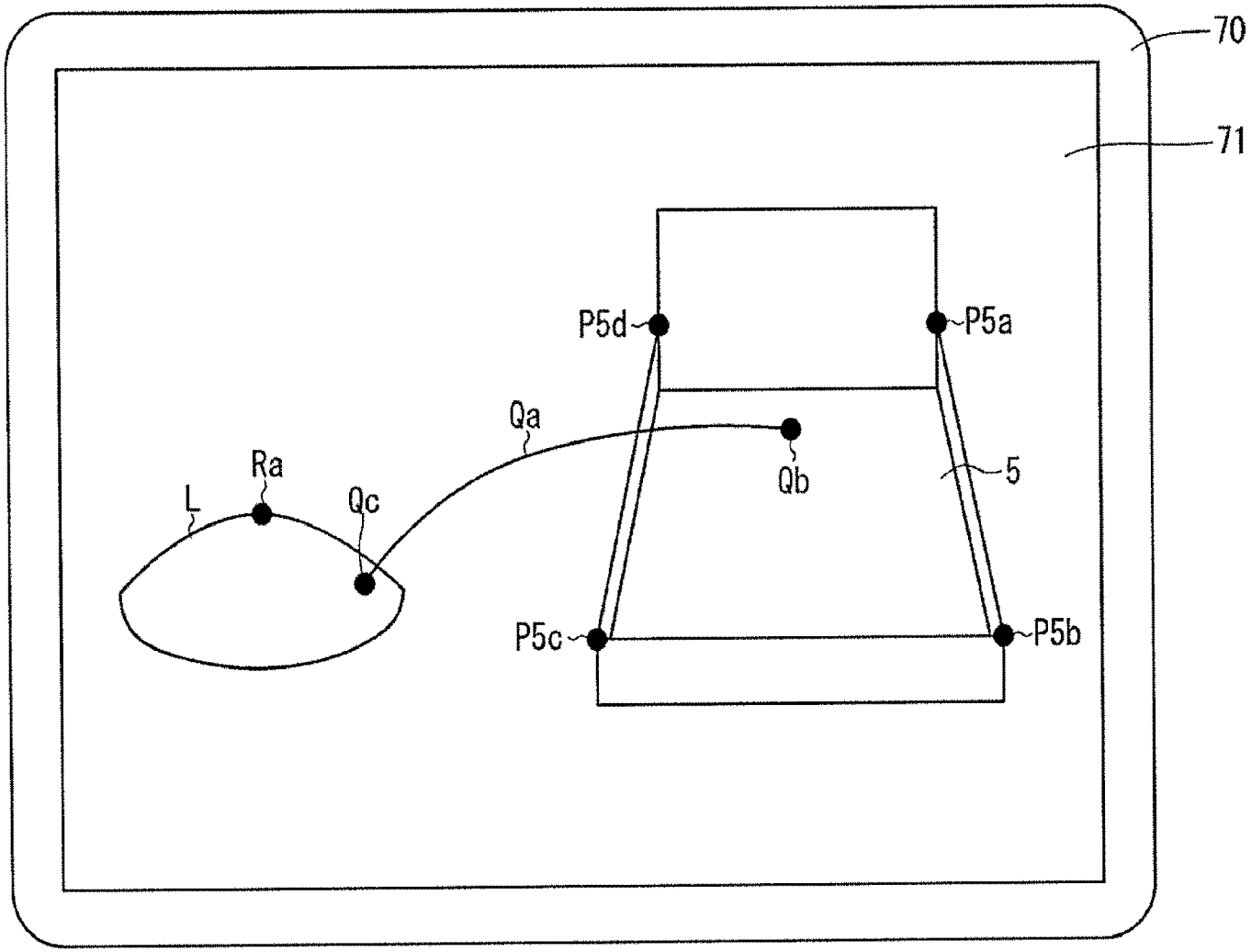
FIG. 6 is a diagram of the display unit 71 shown in FIG. 2.

The loading control C2 (see step S32 shown in FIG. 3) is control that causes the work machine 20 to repeatedly perform a series of operations including the capturing operation and the releasing operation. Specifically, the loading control C2 is control for causing the work machine 20 to repeatedly perform a series of operations performed in the order of the releasing operation (for example, soil discharging), the returning movement operation (for example, slewing), the capturing operation (for example, excavation), and the lifting movement operation (for example, slewing). The loading control C2 is performed based on a detection result of the position detection unit 41. At least a part of each operation (the releasing operation, the returning movement operation, the capturing operation, and the lifting movement operation) of the loading operation is performed based on the detection result of the position detection unit 41. Specifically, for example, the releasing operation is performed as follows. The controller 50 calculates a three-dimensional position and shape of the platform 5 based on the detection result of the position detection unit 41. Then, the controller 50 causes the distal end attachment 25*c* to release the conveyance object L at a specific position above the platform 5. Specifically, for example, the capturing operation is performed as follows. Based on the detection result of the position detection unit 41, the controller 50 calculates, for example, the three-dimensional position and shape of the conveyance object L (for example, soil and sand mound) before being captured as shown in FIG. 6. Then, the controller 50 causes the distal end attachment 25*c* to capture the conveyance object L at a specific position (for example, a point Qc shown in FIG. 6) of the conveyance object L before being captured.

Figure 3:
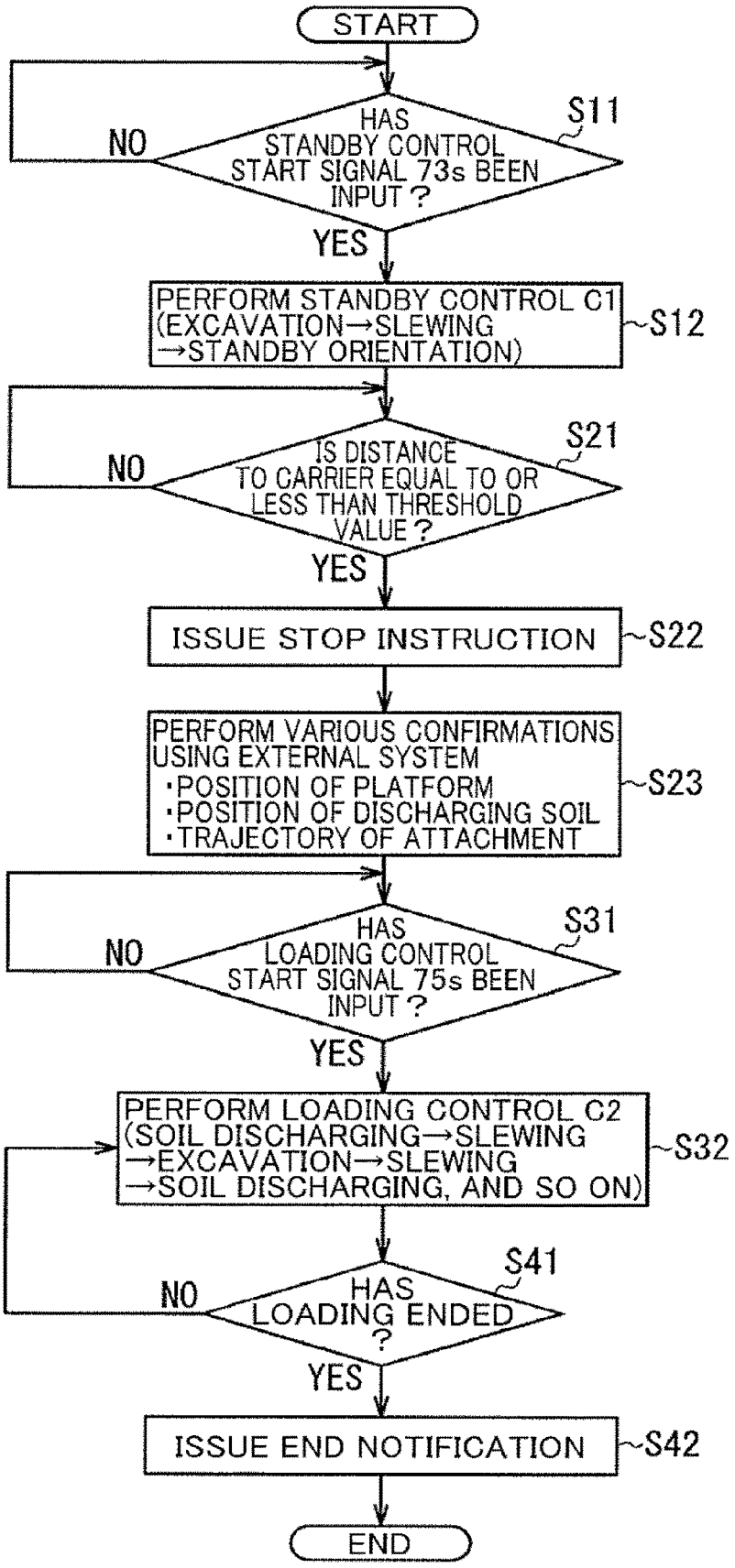
FIG. 3 is a flowchart of an operation of the automatic loading system 10 shown in FIG. 1.

The controller 50 determines which one of the releasing operation, the returning movement operation, the capturing operation, or the lifting movement operation is the operation at the start of the loading control C2 based on the state of the work machine 20 immediately before the start of the loading control C2 (see FIG. 3). For example, when starting the loading control C2 in a state where the work machine 20 is stopped in the standby orientation due to the controller 50 having performed the standby control C1 (see FIG. 3), the controller 50 starts the loading control C2 from the releasing operation. For example, when starting the loading control C2 in a state where the distal end attachment 25*c* is not capturing the conveyance object L (for example, in a state where the bucket is empty), the controller 50 may start the loading control C2 from the returning movement operation or the capturing operation.

(Conditions for Starting Automatic Control, Etc.)

Figure 2:
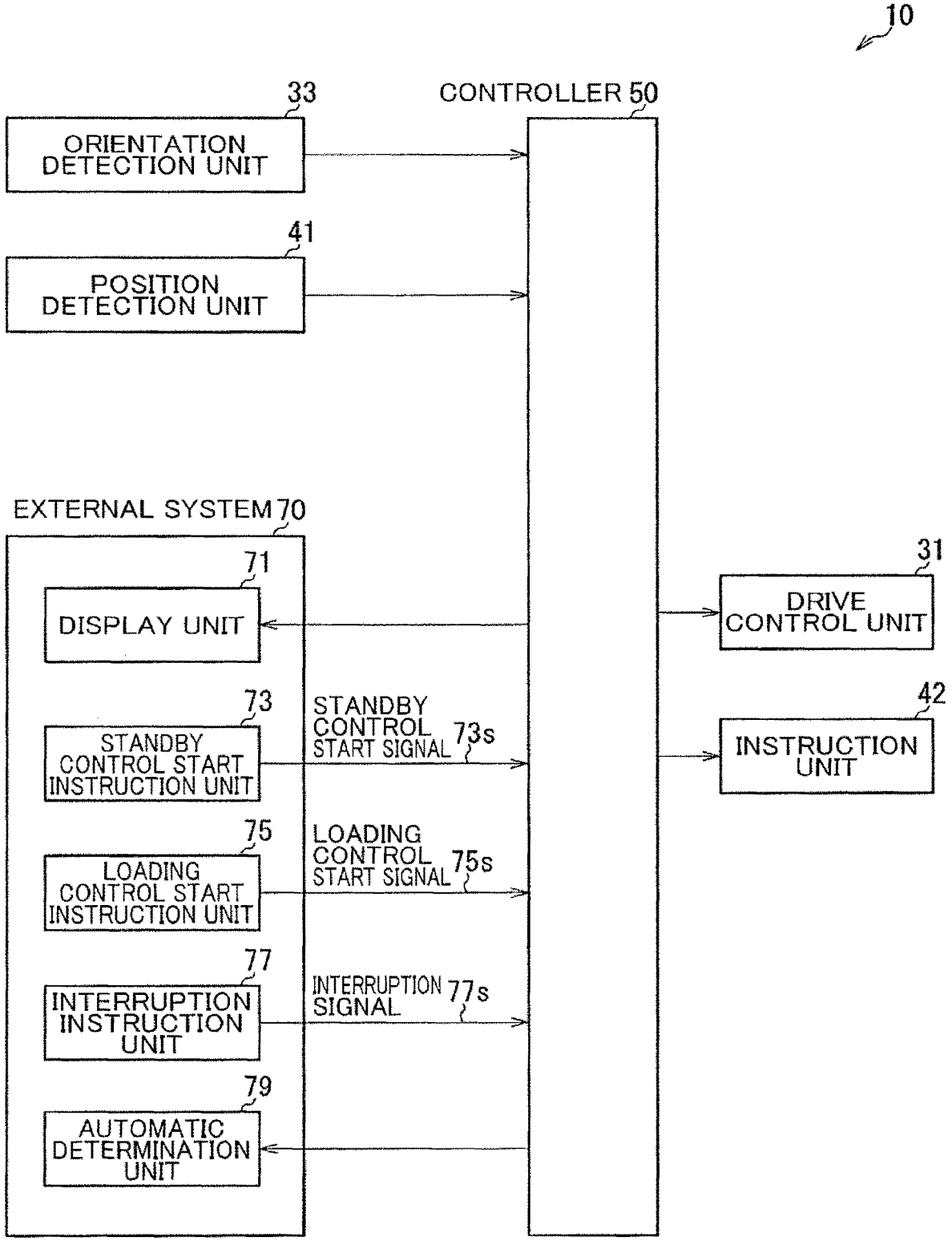
FIG. 2 is a block diagram of the automatic loading system 10 shown in FIG. 1.

The controller 50 starts the standby control C1 on condition that the standby control start signal 73*s* has been input from the external system 70 shown in FIG. 2 to the controller 50. The controller 50 starts the loading control C2 on condition that the loading control start signal 75*s* has been input from the external system 70 to the controller 50. Operation and the like of the automatic loading system 10 will be described with reference to the flowchart shown in FIG. 3.

(Confirmation of Validity of Start of Standby Control C1)

Before the controller 50 starts the standby control C1, the operator confirms whether the standby control C1 can be started (validity). For example, the operator may confirm the presence or absence of an obstacle around a position where the work machine 20 shown in FIG. 1 performs work. For example, the operator may confirm validity of the conveyance object L to be captured by the work machine 20 (the conveyance object L before being captured shown in FIG. 6). For example, the operator may confirm the position of the conveyance object L before being captured, and may confirm the presence or absence and amount of the conveyance object L. For example, the operator may confirm the presence or absence of the conveyance object L conveyed from a belt conveyor (not shown), a machine different from the work machine 20, or the like. As shown in FIG. 6, the external system 70 may output (for example, display on the display unit 71) information for allowing the operator to determine whether the standby control C1 can be started (see [Example B] to [Example E] described later for specific examples).

When determining that the standby control C1 (see FIG. 3) can be started, the operator operates the standby control start instruction unit 73 shown in FIG. 2 to cause the external system 70 to output the standby control start signal 73*s* to the controller 50. When determining that the standby control C1 cannot be started, the operator does not cause the external system 70 to output the standby control start signal 73*s* to the controller 50.

(Operation of Controller 50, Etc.)

The controller 50 determines whether the standby control start signal 73*s* has been input (step S11 shown in FIG. 3). The controller 50 starts the standby control C1 on condition that the standby control start signal 73*s* has been input from the external system 70 to the controller 50 (step S12 shown in FIG. 3). The "condition" may be a necessary condition or a sufficient condition. The controller 50 may start the standby control C1 when a condition different from the condition that the standby control start signal 73*s* has been input is further satisfied. The condition that the controller 50 starts the standby control C1 shown in step S12 in FIG. 3 includes that the standby control start signal 73*s* has been input from the external system 70 to the controller 50.

The controller 50 performs determination related to the position of the carrier 2 with respect to the work machine 20 shown in FIG. 1 (step S21 shown in FIG. 3). For example, the controller 50 determines whether the position of the carrier 2 with respect to the work machine 20 is within a predetermined range. The "predetermined range" is set in the controller 50 in advance (before the determination in step S21). For example, the controller 50 determines whether a distance from the work machine 20 to the carrier 2 is equal to or less than a threshold value. The "threshold value" is set in the controller 50 in advance (before the determination in step S21). The position detection unit 41 detects the position or distance of the carrier 2 with respect to the work machine 20. When the position of the carrier 2 with respect to the work machine 20 is within a predetermined range (for example, the distance is equal to or less than the threshold value), the processing flow proceeds to step S22. When the position of the carrier 2 with respect to the work machine 20 is not within the predetermined range (for example, the distance exceeds the threshold value), the controller 50 continues the determination related to the position of the carrier 2 with respect to the work machine 20 (determination in step S21 shown in FIG. 3). Note that a timing at which the determination in step S21 shown in FIG. 3 is performed may be after the standby control C1 (step S12), before the standby control C1, or at the same time as the standby control C1. The timing at which the determination in step S21 is performed is before the loading control C2 (step S32).

When the determination in step S21 is performed, the carrier 2 shown in FIG. 1 may be possibly moving toward the work machine 20. In this case, when the position of the carrier 2 with respect to the work machine 20 is within a predetermined range (for example, when the distance is equal to or less than the threshold value) (YES in step S21 shown in FIG. 3), the controller 50 causes the instruction unit 42 (sec FIG. 2) to issue a stop instruction. The "stop instruction" is an instruction to stop the carrier 2 moving toward the work machine 20. For example, when the instruction unit 42 issues a stop instruction perceptible by a person, a driver in the carrier cab 3*a* who has perceived the stop instruction (for example, a sound of a horn) stops the carrier 2. For example, when the instruction unit 42 outputs the stop instruction by an electric signal, the carrier 2 that has received the stop instruction may automatically stop.

(Confirmation of Validity of Start of Loading Control C2)

Before the controller 50 starts the loading control C2 (see FIG. 3), the operator confirms whether the loading control C2 can be started (validity). At this time, the operator may confirm the validity of the detection result of the position detection unit 41. The operator may confirm the validity of the position of the carrier 2 with respect to the work machine 20. The operator may confirm validity of the position of the conveyance object L (see FIG. 6), before being captured, with respect to the work machine 20. The operator may confirm the validity of at least one of the target trajectory Qa (see FIG. 6) or a target position (for example, the point Qc, a point Qb, or the like shown in FIG. 6.) of the distal end attachment 25*c* in the loading control C2.

As shown in FIG. 6, the external system 70 outputs information for allowing the operator to confirm whether the loading control C2 can be started, and displays the information on the display unit 71, for example (see step S23 shown in FIG. 3). Specific examples of the output in the external system 70 and the confirmation by the operator are as [Example A] to [Example E] below.

Figure 4:
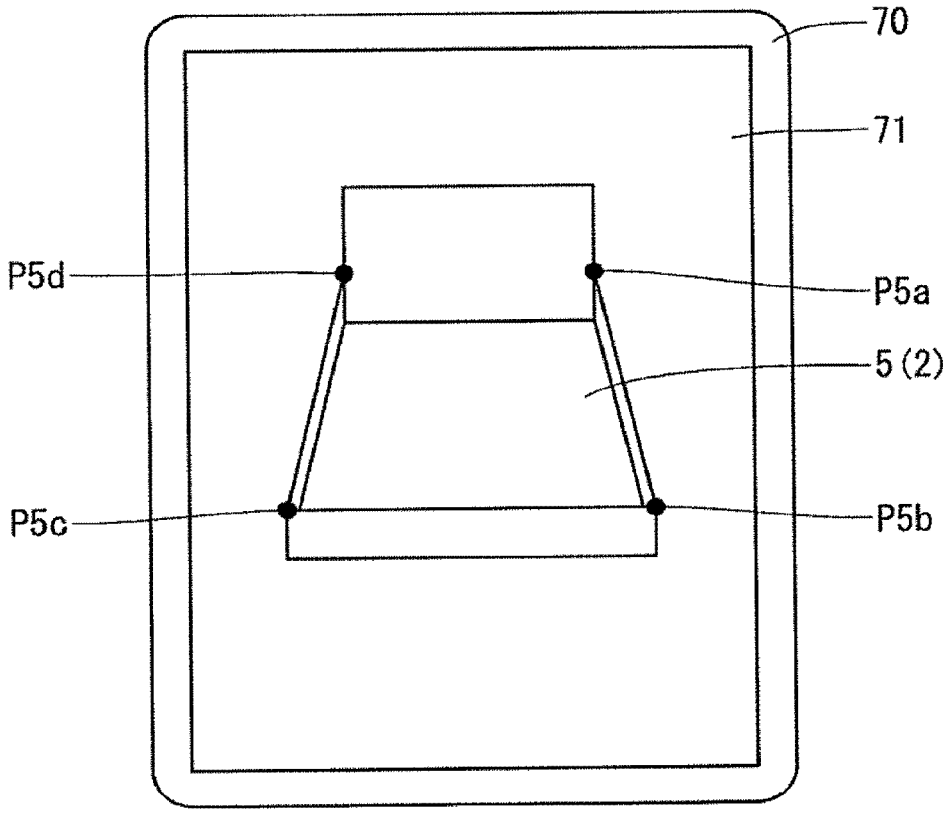
FIG. 4 is a diagram of a display unit 71 shown in FIG. 2 when the position of the carrier 2 shown in FIG. 1 is correctly detected.
Figure 5:
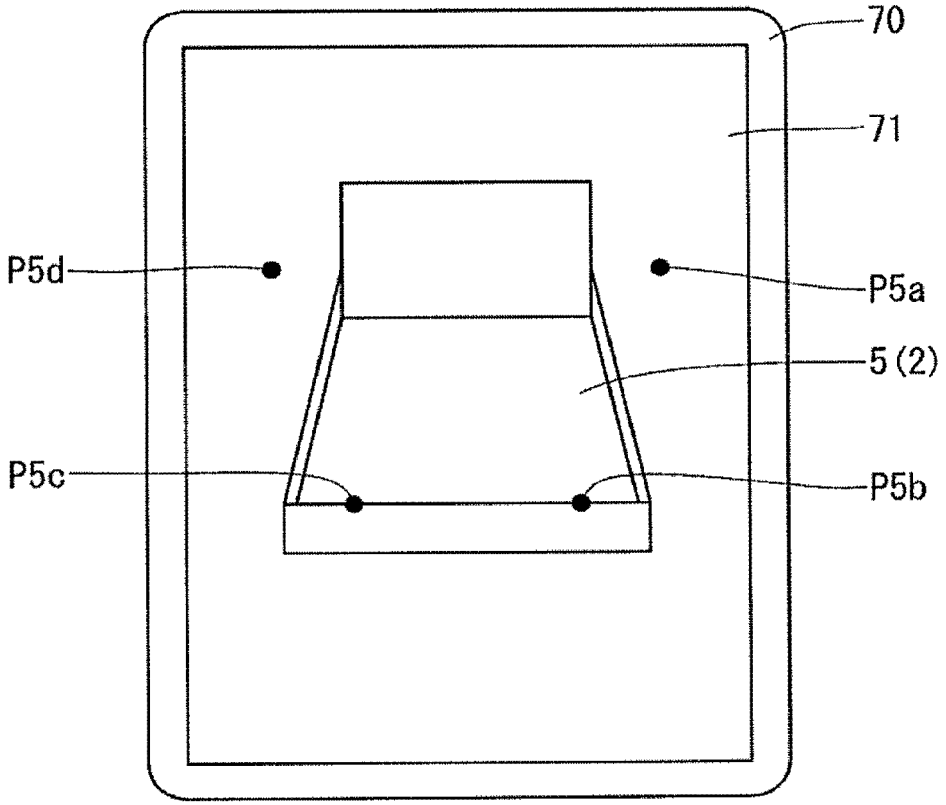
FIG. 5 is a diagram corresponding to FIG. 4, and is a diagram of the display unit 71 when the position of the carrier 2 is erroneously detected.

[Example A] For example, the external system 70 shown in FIG. 1, more specifically, the display unit 71 shown in FIG. 4 may display information (detected position information of the carrier 2) related to the position of the carrier 2 (for example, the platform 5) with respect to the work machine 20, the information being detected by the position detection unit 41. As shown in FIG. 4, the detected position information of the carrier 2 displayed by the external system 70 may be, for example, a point indicating a specific position of the platform 5, or may be a straight line or a figure indicating a range of the platform 5. The point indicating the specific position of the platform 5 may include, for example, four points P5*a*, P5*b*, P5*c*, and P5*d* indicating the four corners of the platform 5. The external system 70 may display a value related to the detected position information of the carrier 2. The value related to the detected position information of the carrier 2 may include, for example, at least either coordinates or a distance of the carrier 2 with respect to the work machine 20. The external system 70 displays the detected position information of the carrier 2 and a two-dimensional image of the carrier 2 (for example, an image of the platform 5) in an overlapping manner. The operator who has viewed this display compares the detected position information of the carrier 2 with the two-dimensional image to determine validity of the detected position information. Specifically, for example, the operator confirms whether the detected position information of the carrier 2 (for example, four points P5*a*, P5*b*, P5*c*, and P5*d*) and a portion corresponding to the detected position information in the two-dimensional image of the carrier 2 (for example, positions of the four corners of the platform 5) coincide or substantially coincide with each other. When the information and the portion coincide or substantially coincide with each other, the operator can determine that the detection result of the position detection unit 41 shown in FIG. 1 is valid. When the information and the portion are greatly deviated (see FIG. 5), the operator can determine that the detection result of the position detection unit 41 is not valid.

[Example B] For example, the external system 70 may display information (detected position information of the conveyance object L) related to the position of the conveyance object L with respect to the work machine 20, the information being detected by the position detection unit 41 (see FIG. 1). For example, the external system 70 may display the information related to the position of the conveyance object L (for example, soil and sand mound) before being captured by the work machine 20. The detected position information of the conveyance object L displayed by the external system 70 may be, for example, a point indicating a specific position of the conveyance object L, or may be a figure indicating a range of the conveyance object L. The point indicating the specific position of the conveyance object L may include, for example, a point Ra indicating a vertex. The external system 70 may display a value related to the detected position information of the conveyance object L. The value related to the detected position information of the conveyance object L may include at least either coordinates or a distance of the conveyance object L with respect to the work machine 20. The external system 70 displays the detected position information of the conveyance object L and a two-dimensional image of the conveyance object L in an overlapping manner as in [Example A]. The operator who has viewed this display can determine the validity of the detection result of the position detection unit 41.

[Example C] For example, as shown in FIG. 6, the external system 70 may display information related to the target trajectory Qa in the loading control C2 (see FIG. 3). The target trajectory Qa is a target trajectory of the distal end attachment 25*c* between the position (point Qc) where the capturing operation is performed and the position (point Qb) where the releasing operation is performed, and is calculated by the controller 50. The external system 70 may display information related to the target trajectory Qa in the lifting movement operation or may display information related to the target trajectory Qa in the returning movement operation. When the target trajectory Qa is automatically corrected in accordance with the position of the carrier 2 detected by the position detection unit 41 or when the target trajectory Qa is manually corrected, the external system 70 may display a correction result of the target trajectory Qa. The external system 70 may display, in an overlapping manner, the information related to the target trajectory Qa and a two-dimensional image of the position through which the attachment 25 is expected to pass. The operator who has viewed this display can determine the validity of the information related to the target trajectory Qa as in [Example A].

[Example D] For example, the external system 70 may display information related to a target loading position (the point Qb) in the loading control C2. The target loading position (point Qb) is a target position at which the work machine 20 shown in FIG. 1 performs the releasing operation, and is calculated by the controller 50. As shown in FIG. 6, the external system 70 may display the target loading position (point Qb). When the target loading position (point Qb) is automatically corrected in accordance with the position of the carrier 2 detected by the position detection unit 41 or when the target loading position (point Qb) is manually corrected, the external system 70 may display a correction result of the target loading position (point Qb). The external system 70 may display the information related to the target loading position (point Qb) and the two-dimensional image of the carrier 2 (for example, the platform 5) in an overlapping manner. The operator who has viewed this display can determine whether the target loading position (point Qb) is valid (for example, whether the target loading position is an appropriate position on the platform 5).

[Example E] The external system 70 may display information related to a target capturing position (the point Qc) in the loading control C2. The target capturing position (point Qc) is a target position at which the work machine 20 shown in FIG. 1 performs the capturing operation, and is calculated by the controller 50. As shown in FIG. 6, the external system 70 may display the target capturing position (point Qc). When the target capturing position (point Qc) is automatically corrected in accordance with the position of the conveyance object L detected by the position detection unit 41 or when the target capturing position (point Qc) is manually corrected, the external system 70 may display a correction result of the target capturing position (point Qc). The external system 70 may display the information related to the target capturing position (point Qc) and a two-dimensional image of the conveyance object L before being captured in an overlapping manner. The operator who has viewed this display can determine whether the target capturing position (point Qc) is valid (for example, whether the target capturing position is an appropriate position in the conveyance object L before being captured).

When determining that the loading control C2 (step S32) shown in FIG. 3 can be started, the operator operates the loading control start instruction unit 75 shown in FIG. 2 to cause the external system 70 to output the loading control start signal 75*s* to the controller 50. When determining that the loading control C2 cannot be started, the operator does not cause the external system 70 to output the loading control start signal 75*s* to the controller 50.

(Operation of Controller 50, etc.)

The controller 50 determines whether the loading control start signal 75*s* has been input (step S31 shown in FIG. 3). The controller 50 starts the loading control C2 on condition that the loading control start signal 75*s* has been input from the external system 70 to the controller 50 (step S32 shown in FIG. 3). The "condition" may be a necessary condition or a sufficient condition. The controller 50 may start the loading control C2 when a condition (additional condition) different from the condition that the loading control start signal 75*s* has been input is further satisfied. The condition that the controller 50 starts the loading control C2 (step S32 in shown in FIG. 3) includes that the loading control start signal 75*s* has been input from the external system 70 to the controller 50. The above-described "additional condition" may be, for example, that the position of the carrier 2 with respect to the work machine 20 shown in FIG. 1 is within a predetermined range (YES in step S21 shown in FIG. 3). The additional condition may be that the stop instruction for the carrier 2 (step S22 shown in FIG. 3) has been completed.

The controller 50 determines whether to end the loading control C2 while performing the loading control C2 (step S41 shown in FIG. 3). For example, when an amount of the conveyance object L loaded on the carrier 2 exceeds a predetermined amount, the controller 50 ends the loading control C2. The amount of the conveyance object L loaded on the carrier 2 may be detected by the position detection unit 41 or by a sensor other than the position detection unit 41. For example, the controller 50 may interrupt the loading control C2 when the interruption signal 77*s* is input from the external system 70 shown in FIG. 2. When determining not to end the loading control C2, the controller 50 continues the loading control C2. When a signal for restarting the loading control C2 (for example, the loading control start signal 75*s*) is input while the loading control C2 is interrupted, the controller 50 may restart the loading control C2.

When ending the loading control C2 (YES in step S41 shown in FIG. 3), the controller 50 notifies that the loading control C2 is ended (this notification is referred to as end notification). The controller 50 causes the instruction unit 42 to output the end notification. For example, in a case where the instruction unit 42 issues an instruction perceptible by a person (for example, a horn or the like), the driver of the carrier 2 shown in FIG. 1 may perceive the end notification (for example, hear sound of the horn) and cause the carrier 2 to travel (depart). For example, when the instruction unit 42 outputs the end notification by an electric signal, the carrier 2 that has received the end notification may automatically travel (depart). For example, the external system 70 may receive the end notification from the controller 50 and output that the loading has ended. For example, the display unit 71 may display an indication that loading has ended. Note that the instruction unit 42 that issues the stop instruction (see step S22 shown in FIG. 3) and the instruction unit 42 that issues the end notification (see step S42 shown in FIG. 3) may be shared or need not be shared.

(Modifications)

In the above examples, the operator has confirmed the validity of the start of the automatic control (the standby control C1 and the loading control C2 shown in FIG. 3). Alternatively, as shown in FIG. 2, the external system 70 may include the automatic determination unit 79 that automatically determines the validity of the start of the automatic control. In this case, the automatic determination unit 79 uses artificial intelligence (AI), for example, to determine the validity of the start of the automatic control. When determining that the start of the standby control C1 is valid, the automatic determination unit 79 causes the external system 70 to output the standby control start signal 73*s*. When determining that the start of the standby control C1 is not valid, the automatic determination unit 79 does not cause the external system 70 to output the standby control start signal 73*s*. When determining that the start of the loading control C2 is valid, the automatic determination unit 79 causes the external system 70 to output the loading control start signal 75*s*. When determining that the start of the loading control C2 is not valid, the automatic determination unit 79 does not cause the external system 70 to output the loading control start signal 75*s*.

Specifically, for example, in [Example A], the operator compares the detected position information (for example, four points P5*a* to P5*d*) of the carrier 2 shown in FIG. 4 with a portion (for example, positions of the four corners of the platform 5) corresponding to the detected position information of the two-dimensional image of the carrier 2. On the other hand, in the present modification, the automatic determination unit 79 (see FIG. 2) automatically performs this comparison by, for example, image processing. Then, when determining that the start of the loading control C2 is valid, the automatic determination unit 79 causes the external system 70 to output the loading control start signal 75*s*. The same applies to the above [Example B] to [Example E]. Note that the automatic determination unit 79 can be omitted.

(Effects of First Invention)

Effects of the automatic loading system 10 shown in FIG. 1 are as follows. The automatic loading system 10 includes the work machine 20, the position detection unit 41, the controller 50, and the external system 70. The work machine 20 performs the capturing operation of capturing the conveyance object L and the releasing operation of loading the captured conveyance object L on the carrier 2. The position detection unit 41 detects the position of the carrier 2 with respect to the work machine 20. The controller 50 is installed in the work machine 20 and can perform the loading control C2 (see step S32 shown in FIG. 3) based on the detection result of the position detection unit 41. The external system 70 is arrangeable outside the work machine 20 and communicable with the controller 50. The loading control C2 is control that causes the work machine 20 to repeatedly perform a series of operations including the capturing operation and the releasing operation.

[Configuration 1] As shown in FIG. 2, the external system 70 can output the loading control start signal 75*s* for starting the loading control C2. The controller 50 starts the loading control C2 on condition that the loading control start signal 75*s* has been input from the external system 70 to the controller 50.

In [Configuration 1] described above, the loading control C2 is not started unless the loading control start signal 75*s* is input from the external system 70 to the controller 50. It is therefore possible to create a room for a determination subject other than the controller 50 to determine, before the loading control C2 is started, whether the loading control C2 can be started.

For example, the loading control C2 is performed based on the detection result of the position detection unit 41, and the validity of the detection result of the position detection unit 41 can be determined by a determination subject other than the controller 50. The determination subject other than the controller 50 may include at least either the operator (person) or the automatic determination unit 79 (for example, AI).

(Effects of Second Invention)

The controller 50 can perform the standby control C1 (see step S12 shown in FIG. 3). The standby control C1 is control that causes the work machine 20 shown in FIG. 1 to perform the capturing operation and causes the work machine 20 to stand by in a specific orientation for loading the captured conveyance object L on the carrier 2.

[Configuration 2] As shown in FIG. 2, the external system 70 can output the standby control start signal 73*s* for starting the standby control C1. The controller 50 starts the standby control C1 on condition that the standby control start signal 73*s* has been input from the external system 70 to the controller 50.

In [Configuration 2] described above, the standby control C1 is not started unless the standby control start signal 73*s* is input from the external system 70 to the controller 50. It is therefore possible to create a room for a determination subject other than the controller 50 shown in FIG. 2 to determine, before the standby control C1 shown in FIG. 3 is started, whether the standby control C1 can be started.

In [Configuration 1] and [Configuration 2] described above, the external system 70 outputs different types of signals (the standby control start signal 73*s* and the loading control start signal 75*s*). Therefore, by changing the type of the signal output from the external system 70, the external system 70 can instruct the controller 50 to start a plurality of types of automatic control (specifically, the standby control C1 and the loading control C2 shown in FIG. 3).

(Effects of Third Invention)

[Configuration 3] As shown in FIG. 4, the external system 70 displays information related to the position of the carrier 2 detected by the position detection unit 41 (see FIG. 1).

In [Configuration 3], the external system 70 allows the operator to confirm validity of the information related to the position of the carrier 2 detected by the position detection unit 41. Therefore, the operator can easily determine whether the automatic control (the standby control C1 or the loading control C2 shown in FIG. 3) can be started.

(Effects of Fourth Invention)

[Configuration 4] As shown in FIG. 6, the external system 70 displays information related to the position (loading position (point Qb)) where the work machine 20 loads the conveyance object L on the carrier 2.

In [Configuration 4], the external system 70 allows the operator to confirm validity of the information related to the loading position (point Qb) of the conveyance object L. Therefore, the operator can easily determine whether the automatic control (the standby control C1 or the loading control C2 shown in FIG. 3) can be started.

(Effects of Fifth Invention)

[Configuration 5] As shown in FIG. 1, the work machine 20 includes the distal end attachment 25*c* that captures, moves, and releases the conveyance object L. As shown in FIG. 6, the external system 70 displays information related to the target trajectory Qa of the distal end attachment 25*c* between the position where the capturing operation is performed and the position where the releasing operation is performed.

In [Configuration 5], the external system 70 allows the operator to confirm the information related to the target trajectory Qa of the attachment 25. Therefore, the operator can easily determine whether the automatic control (the standby control C1 or the loading control C2 shown in FIG. 3) can be started.

(Other Modifications)

The above embodiment may be variously modified. For example, the arrangement, shape, connection, and the like of each component of the embodiment may be changed. For example, the order of the steps in the flowchart shown in FIG. 3 may be changed, and some of the steps need not be performed. For example, the threshold value, the range, and the like (see, for example, step S21) may be constant, may be changed by manual operation, or may be automatically changed in accordance with some condition. For example, the number of components may be changed, and some of the components need not be provided. For example, a plurality of parts different from each other may be described as one part. For example, what has been described as one part may be provided separately in a plurality of different parts. For example, the external system 70 may be one object or may be provided in a plurality of parts. Specifically, for example, the external system 70 may be separated into a part (for example, a tablet terminal) including the display unit 71, the standby control start instruction unit 73, the loading control start instruction unit 75, and the interruption instruction unit 77 and into the automatic determination unit 79 (for example, a server).

The invention claimed is:

1. An automatic loading system comprising:

a work machine that performs a capturing operation of capturing a conveyance object and a releasing operation of loading the conveyance object having been captured on a carrier;

a position detector that detects a position of the carrier with respect to the work machine;

a controller installed in the work machine and configured to perform loading control based on a detection result of the position detector; and an external system that is arrangeable outside the work machine and communicable with the controller, the external system including a display, wherein the loading control is control that causes the work machine to repeatedly perform a series of operations including the capturing operation and the releasing operation, wherein the work machine includes an attachment including a distal end attachment that captures, moves, and releases the conveyance object, wherein the external system displays, on the display, information for allowing an operator to confirm whether the loading control can be started, wherein the information is first information, second information, third information, forth information or fifth information, the first information being information related to the position of the carrier with respect to the work machine, the second information being information related to a position of the conveyance object with respect to the work machine, the third information being information related to a target trajectory of the distal end attachment between a position where the capturing operation is performed and a position where the releasing operation is performed, the forth information being information related to a target loading position at which the work machine performs the releasing operation in the loading control, the fifth information being information related to a target capturing position at which the work machine performs the capturing operation in the loading control, wherein the external system is configured to output a loading control start signal for starting the loading control after the operator confirms that the loading control can be started, and wherein the controller starts the loading control on condition that the loading control start signal has been input from the external system to the controller.

2. The automatic loading system according to claim 1, wherein the controller is configured to perform standby control, the standby control is control that causes the work machine to perform the capturing operation and causes the work machine to stand by in a specific orientation for loading the conveyance object having been captured on the carrier, the external system is configured to output a standby control start signal for starting the standby control, and the controller starts the standby control on condition that the standby control start signal has been input from the external system to the controller.

3. The automatic loading system according to claim 1, wherein the carrier includes a platform, the first information is information related to a point indicating a specific position of the platform, a straight line indicating a range of the platform, a figure indicating a range of the platform, coordinates of the carrier with respect to the work machine, or a distance of the carrier with respect to the work machine, and the external system is configured to display the first information and a two-dimensional image of the carrier in an overlapping manner.

4. The automatic loading system according to claim 1, wherein the second information is information related to a point indicating a specific position of the conveyance object, a figure indicating a range of the conveyance object, coordinates of the conveyance object with respect to the work machine, or a distance of the conveyance object with respect to the work machine, and the external system is configured to display the second information and a two-dimensional image of the conveyance object in an overlapping manner.

5. The automatic loading system according to claim 1, wherein the external system is configured to display the third information related to the target trajectory and a two-dimensional image of a position through which the attachment is expected to pass.

6. The automatic loading system according to claim 1, wherein the external system is configured to display the forth information related to the target loading position and a two-dimensional image of the carrier in an overlapping manner.

7. The automatic loading system according to claim 1, wherein the external system is configured to display, in an overlapping manner, the fifth information related to the target capturing position and a two-dimensional image of the conveyance object before being captured.

* * * * *